US007861703B2

(12) United States Patent
Liao

(10) Patent No.: US 7,861,703 B2
(45) Date of Patent: Jan. 4, 2011

(54) PAINTBALL GUN

(75) Inventor: Sheng-Jen Liao, Fongyuan (TW)

(73) Assignee: Yao-Gwo Gan, Taichung (TW)

( * ) Notice: Subject to any disclaimer, the term of this patent is extended or adjusted under 35 U.S.C. 154(b) by 148 days.

(21) Appl. No.: 12/367,430

(22) Filed: Feb. 6, 2009

(65) Prior Publication Data

US 2010/0199961 A1 Aug. 12, 2010

(51) Int. Cl.
*F41B 11/00* (2006.01)

(52) U.S. Cl. ..... 124/77

(58) Field of Classification Search ..... 124/71–77
See application file for complete search history.

(56) References Cited

U.S. PATENT DOCUMENTS

| | | | | |
|---|---|---|---|---|
| 4,936,282 | A * | 6/1990 | Dobbins et al. | 124/74 |
| 5,778,868 | A * | 7/1998 | Shepherd | 124/76 |
| 5,954,043 | A * | 9/1999 | Mayville et al. | 124/75 |
| 6,601,780 | B1 * | 8/2003 | Sheng | 239/337 |
| 7,395,819 | B2 * | 7/2008 | Dobbins et al. | 124/71 |
| 7,451,755 | B2 * | 11/2008 | Dobbins et al. | 124/71 |
| 7,461,646 | B2 * | 12/2008 | Jones | 124/77 |
| 7,527,049 | B2 * | 5/2009 | Sheng | 124/73 |
| 7,597,097 | B2 * | 10/2009 | Gan | 124/77 |
| 7,617,820 | B2 * | 11/2009 | Jones | 124/77 |
| 7,640,925 | B2 * | 1/2010 | Jones | 124/73 |
| 7,640,926 | B2 * | 1/2010 | Jones | 124/74 |
| 2004/0089280 | A1 * | 5/2004 | Kunimoto | 124/76 |
| 2005/0005924 | A1 * | 1/2005 | Sheng | 124/74 |
| 2006/0027221 | A1 * | 2/2006 | Farrell | 124/31 |
| 2006/0124118 | A1 * | 6/2006 | Dobbins | 124/77 |
| 2006/0157043 | A1 * | 7/2006 | Jones | 124/74 |
| 2006/0162716 | A1 * | 7/2006 | Dobbins et al. | 124/77 |
| 2006/0278206 | A1 * | 12/2006 | Dobbins et al. | 124/74 |
| 2007/0028909 | A1 * | 2/2007 | Wood | 124/73 |
| 2007/0113836 | A1 * | 5/2007 | Dobbins | 124/73 |
| 2007/0175465 | A1 * | 8/2007 | Quinn et al. | 124/74 |
| 2007/0209650 | A1 * | 9/2007 | Jones | 124/73 |
| 2008/0264399 | A1 * | 10/2008 | Dobbins et al. | 124/71 |
| 2009/0064981 | A1 * | 3/2009 | Dobbins et al. | 124/71 |
| 2009/0101129 | A1 * | 4/2009 | Wood et al. | 124/77 |
| 2009/0133682 | A1 * | 5/2009 | Dobbins | 124/77 |
| 2010/0051008 | A1 * | 3/2010 | Lian | 124/73 |
| 2010/0083944 | A1 * | 4/2010 | Dobbins | 124/73 |
| 2010/0101550 | A1 * | 4/2010 | Carnall | 124/76 |
| 2010/0108049 | A1 * | 5/2010 | Dobbins | 124/77 |
| 2010/0170492 | A1 * | 7/2010 | Tiberius et al. | 124/74 |

* cited by examiner

*Primary Examiner*—Troy Chambers

(57) ABSTRACT

A paintball gun includes an air valve and a body portion, in which the body portion includes a paintball hole, a communicator, a piston, an axle and a bolt. By the pneumatic control of the air valve, the piston is pushed between the first and second positions, and the movement of the bolt is controlled between the third and fourth positions, so as to control the pneumatic air to flow out of the projection passage to project the paintball.

4 Claims, 5 Drawing Sheets

PAINTBALL GUN

BACKGROUND OF THE INVENTION

1. Field of the Invention

The present invention relates to a paintball gun with high performance, low air consumption.

2. Description of the Prior Art

The paintball sport has been played for decades and is widely spread around the globe. The paintball gun is the main piece of equipment in the sport of paintball, and it is ameliorated constantly such that it has become a mature technical field.

In a conventional paintball gun, the gun body thereof mainly includes a bolt, some valve assemblies and air passages. Therefore, to further increase the compressed air efficiency and the carry of paintball as well as to reduce the failure rate of paintball gun are still the primary object for the people skilled in this art.

SUMMARY OF THE INVENTION

The main object of the present invention is to provide a paintball gun with high performance, low air consumption.

To achieve the above object, a paintball gun is provided. The paintball gun includes an air valve and a body portion. The body portion includes a paintball hole, a communicator, a piston, an axle and a bolt.

By the pneumatic control of the air valve, the piston is pushed between the first and second positions, and the movement of the bolt is controlled between the third and fourth positions, so as to control the pneumatic air to flow out of the projection passage to project the paintball.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
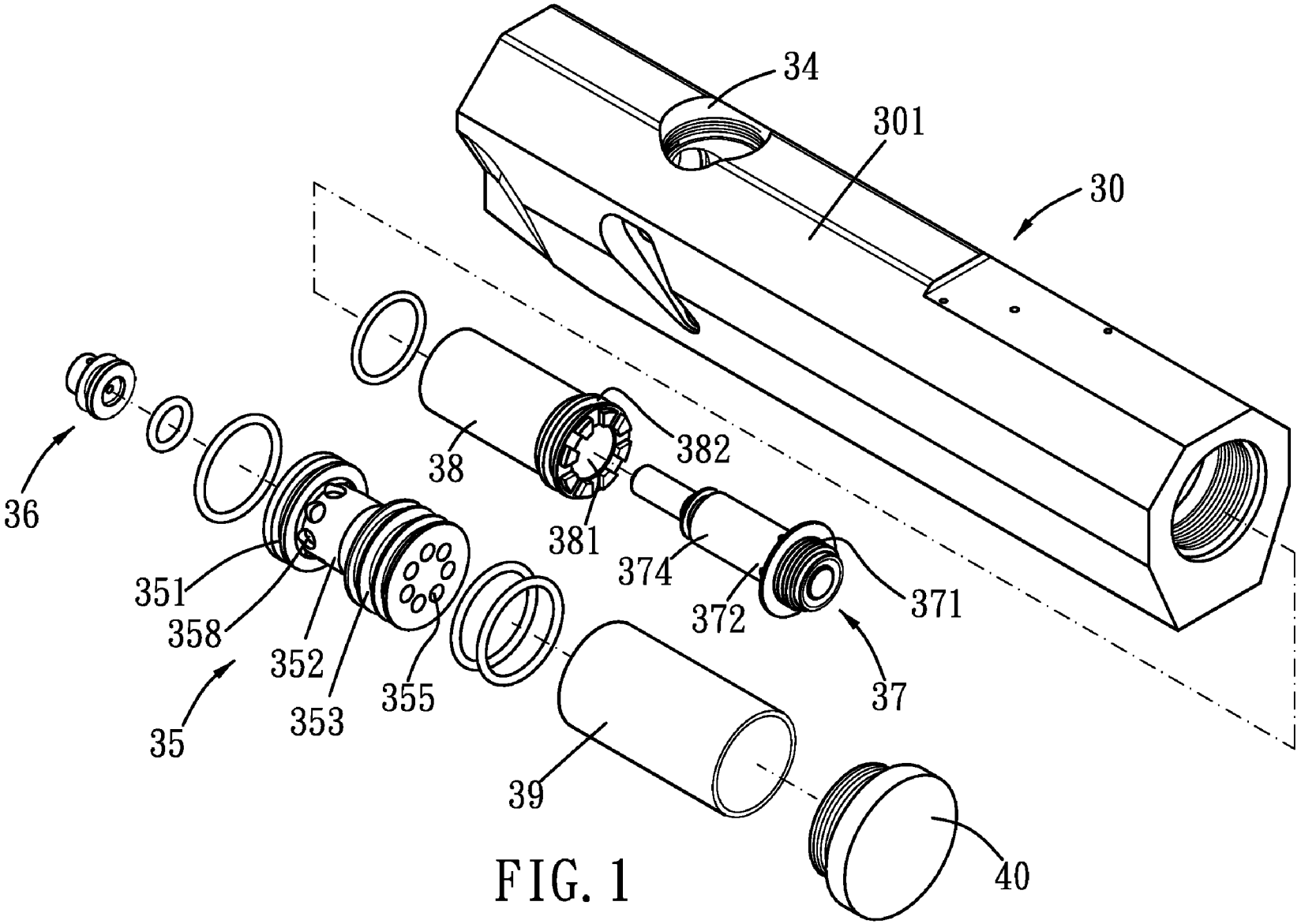
FIG. 1 is a breakdown drawing showing a paintball gun in accordance with a preferred embodiment of the present invention.
Figure 2:
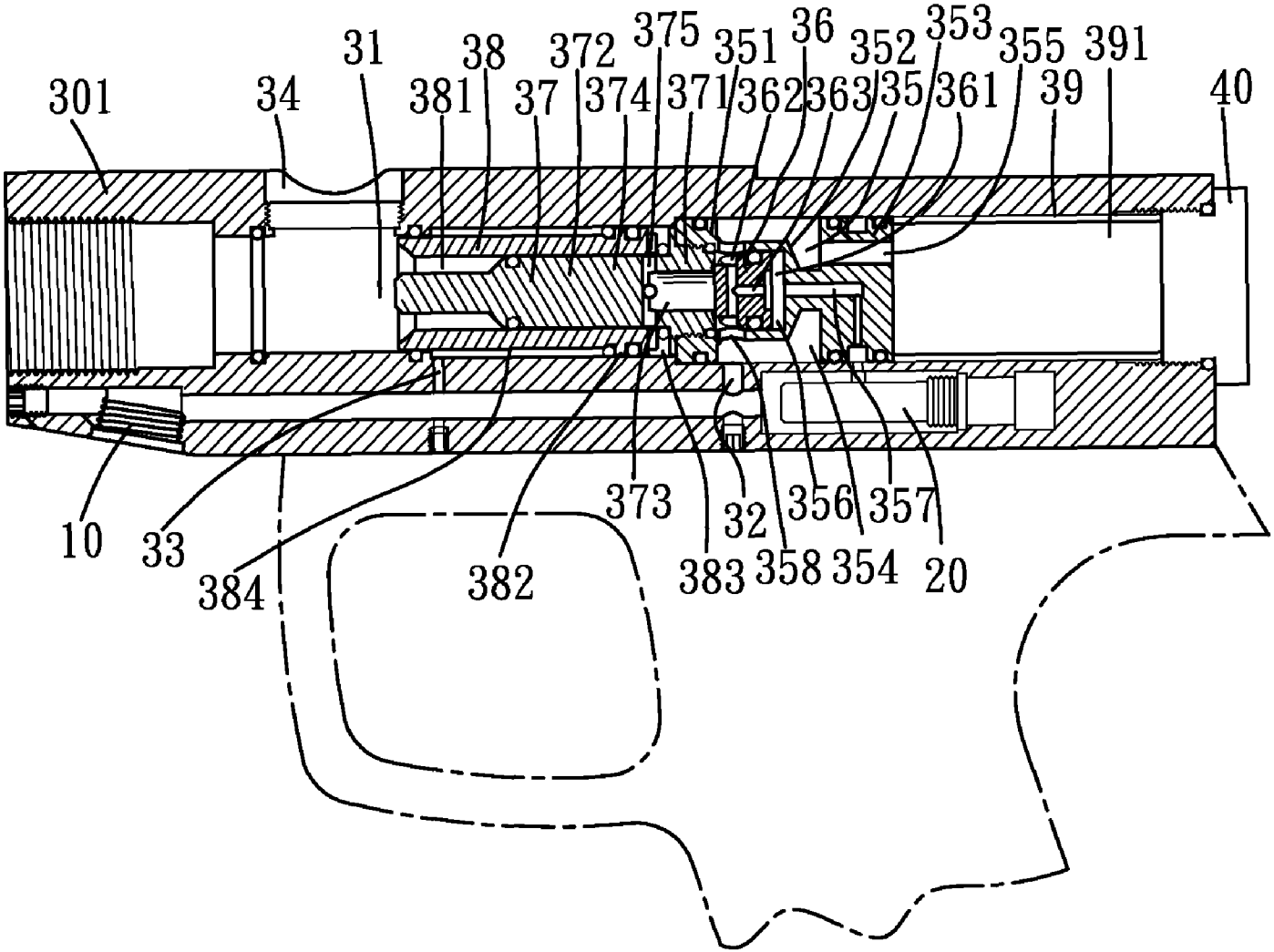
FIG. 2 is a profile showing a paintball gun in accordance with a preferred embodiment of the present invention.

First, please refer to FIG. 1 and FIG. 2. A paintball gun of the present invention includes a pneumatic air source (not shown, will connect to a combining portion 10 if there's any), an air valve 20, a body portion 30, a grip, a trigger (not shown) and a barrel (not shown). One end of the air valve 20 communicates the surrounding, and it is selectively turned open or closed corresponding to the motion of the trigger.

In the present embodiment, the body portion 30 includes a main body 301, which has a hollow receiving room 31, a first air bore 32 and a second air bore 33. And, the body portion 30 further includes a paintball hole 34, a communicator 35, a piston 36, an axle 37, a bolt 38, an air storage 39 and a rear cover 40. In addition, the main body 301 further has an inlet communicating with the combining portion 10 so that the inlet is filled with pneumatic air.

The rear cover 40 is fastened to a rear end of the main body 301, while the air storage 39 is installed in the main body 301. An air chamber 391 is defined within the air storage 39. The paintball hole 34 is disposed at a relative front portion of the main body 301 to load a paintball into the receiving room 31 therefrom.

The communicator 35 is disposed in the receiving room 31, and it has a front section 351, a middle section 352 and a rear section 353. An outer diameter of the middle section 352 is smaller than those of the front and rear sections 351, 353, and a first chamber 354 is defined between the middle section 352 and the main body 301. Between the air chamber 391 and the first chamber 354 is axially disposed a first passage 355 which communicates both the air chamber 391 and the first chamber 354, and the first chamber 354 further communicates with the pneumatic air source through the first air bore 32. The communicator 35 further has a receiving space 356 which is disposed axially and rearward from the front section 351. On one end of the receiving space 356 away from the front section 351 is disposed a second passage 357, and at a predetermined position of the middle section 352 is disposed a third passage 358.

The piston 36 is disposed in the receiving space 356, and it is movable between a first position and a second position. Moreover, the piston 36 divides the receiving space 356 into a second chamber 361 and a third chamber 362, and on the piston 36 is disposed a fourth passage 363 which communicates the second and third chambers 361, 362. In addition, the second passage 357 communicates the second chamber 361 with the air valve 20, and the third passage 358 communicates the third chamber 362 with the first chamber 354. Furthermore, a contacting area between the second chamber 361 and the piston 36 is a first surface, and a contacting area between the third chamber 362 and the piston 36 is a second surface which an area thereof is smaller than that of the first surface.

The axle 37 has a first end 371 and a second end 372. The first end 371 is fastened to the front section 351 of the communicator 35, and an air passage 373, which communicates with the third chamber 362, is disposed in the first end 371. The second end 372 is formed with a cylindrical-shaped rod 374 in which at a predetermined position of the rod 374 is disposed a plurality of holes 375.

The bolt 38 is movable between a third position and a fourth position, and it has a projection passage 381. A bore diameter of the projection passage 381 is not smaller than an outer diameter of the rod 374. At a predetermined position of an outer periphery of the bolt 38 is formed with an annular flange 382 with an outer diameter larger than that of the rod 374. In the present embodiment, the annular flange 382 is disposed at a portion of the bolt 38 close to the communicator 35. In which, between the axle 374, the annular flange 382 and the main body 301 is defined a fourth chamber 383, and between the bolt 38, the annular flange 382 and the main body 301 is disposed a fifth chamber 384. In addition, a contacting area between the fourth chamber 383 and the annular flange 382 is third surface, and a contacting area between the fifth chamber 384 and the annular flange 382 is a fourth surface. The area of the third surface is larger than that of the fourth surface. Furthermore, the holes 375 of the rod 374 communicates the fourth chamber 383 with the air passage 373 of the axle 37, and the second air bore 33 communicates the fifth chamber 384 with the inlet.

Figure 3:
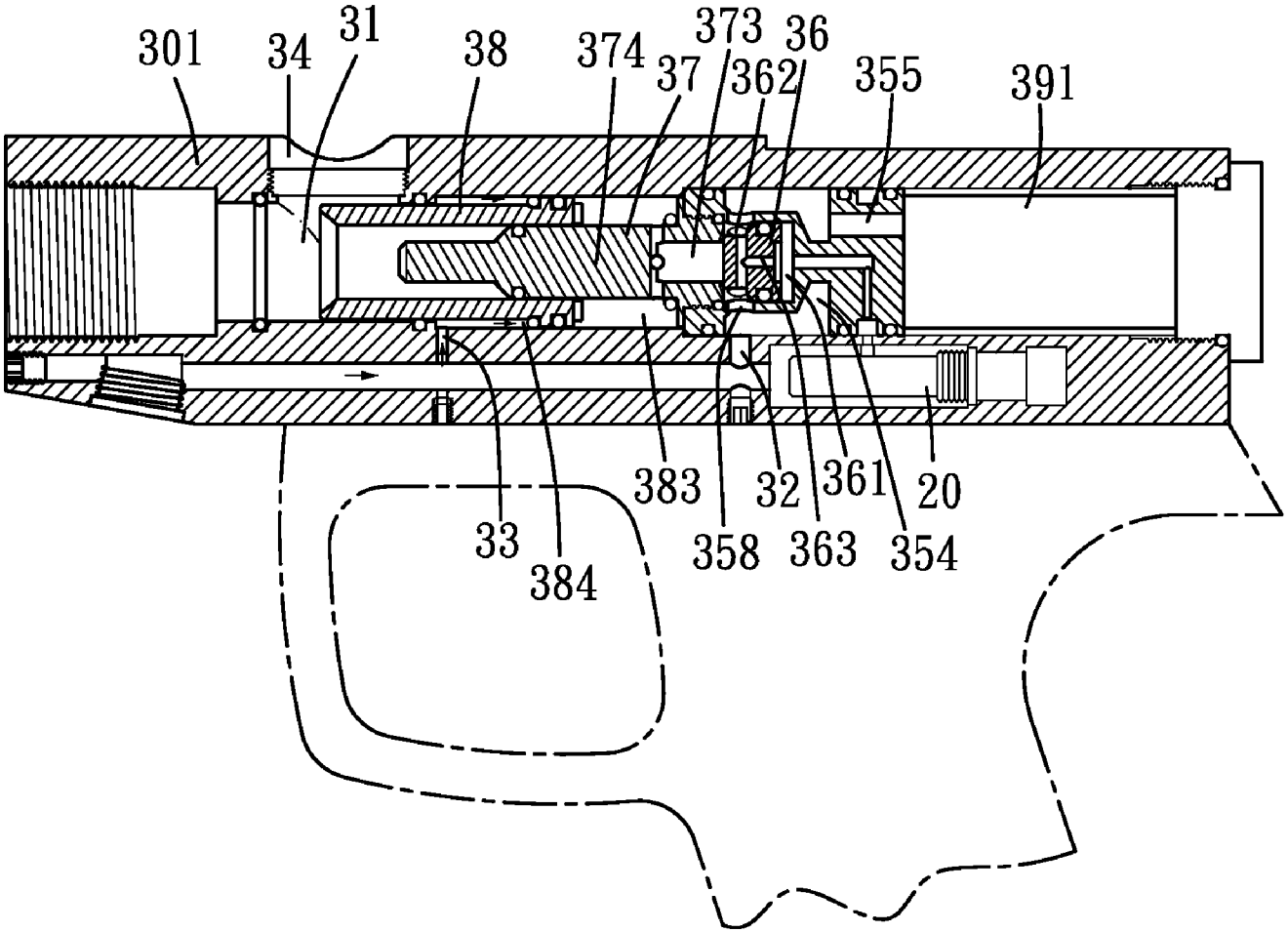
FIG. 3 is a profile showing a pneumatic movement (I) of a paintball gun in accordance with a preferred embodiment of the present invention, in which the air valve is closed.

Please refer to FIG. 2 and FIG. 3. When the air valve 20 is closed, the pneumatic air in the inlet flows into the first chamber 354 via the first air bore 32, and then the air flows into the air chamber 391 via the first passage 355, into the third chamber 362 via the third passage 358, and into the second chamber 361 via the fourth passage 363. Because the area of the first surface is larger than that of the second surface, the piston 36 is then pushed to the first position and shuts the air passage 373 of the axle 37. Meanwhile, the bolt 38 is at the third position and tightly sleeves the rod 374 of the axle 37, opening the paintball hole 34 for a paintball to drop into the receiving room 31. In the present embodiment, the pneumatic air also flows into the fifth chamber 384 via the second air bore 33, so that the bolt 38 can be pushed back to the third position by the pneumatic air in the fifth chamber 384; however, a spring can be installed in the fifth chamber 384 to push the bolt 38 backward, and it will, therefore, no longer be necessary to dispose the second air bore 33.

Figure 4:
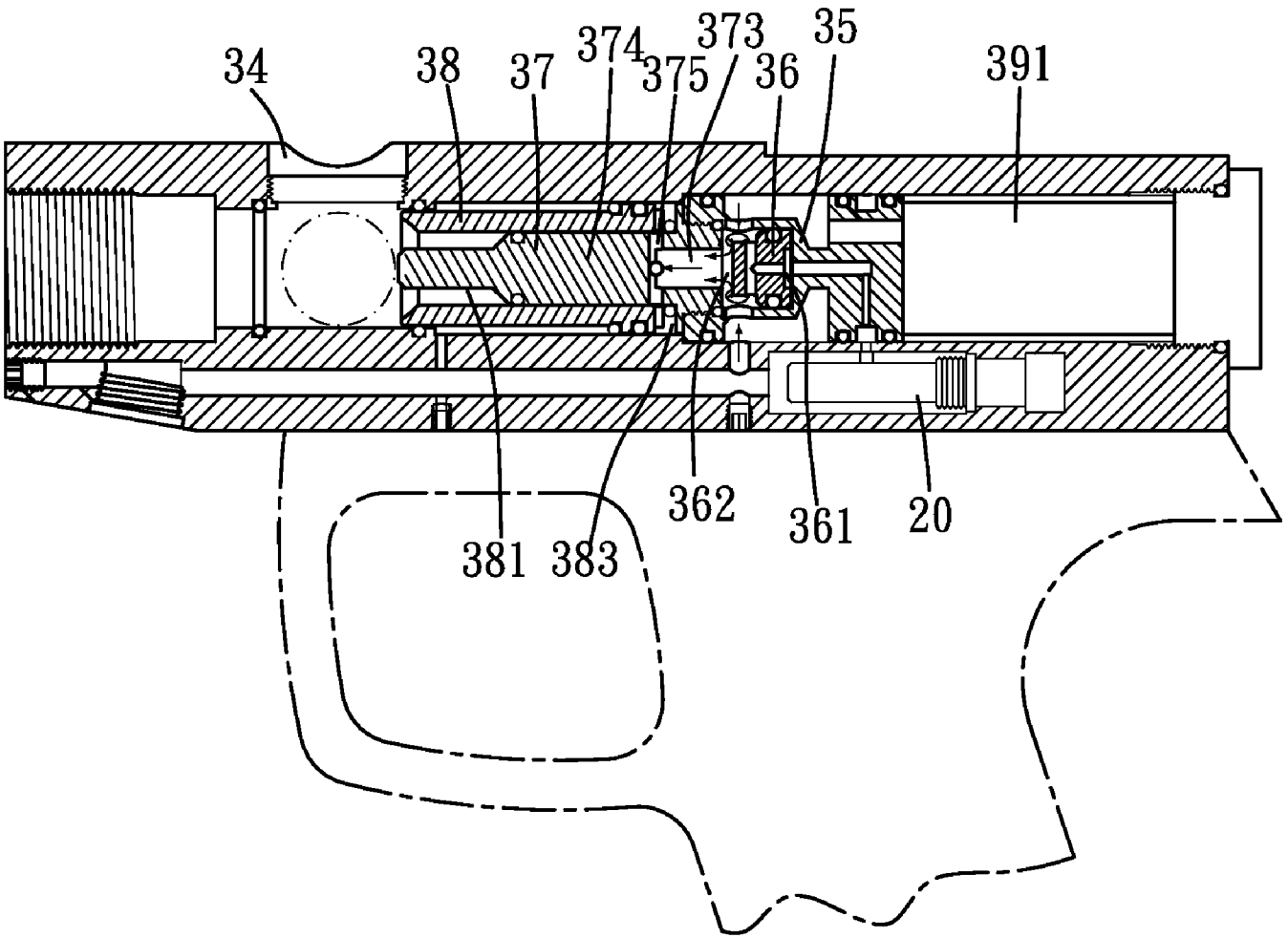
FIG. 4 is a profile showing a pneumatic movement (II) of a paintball gun in accordance with a preferred embodiment of the present invention, in which the air valve is open.
Figure 5:
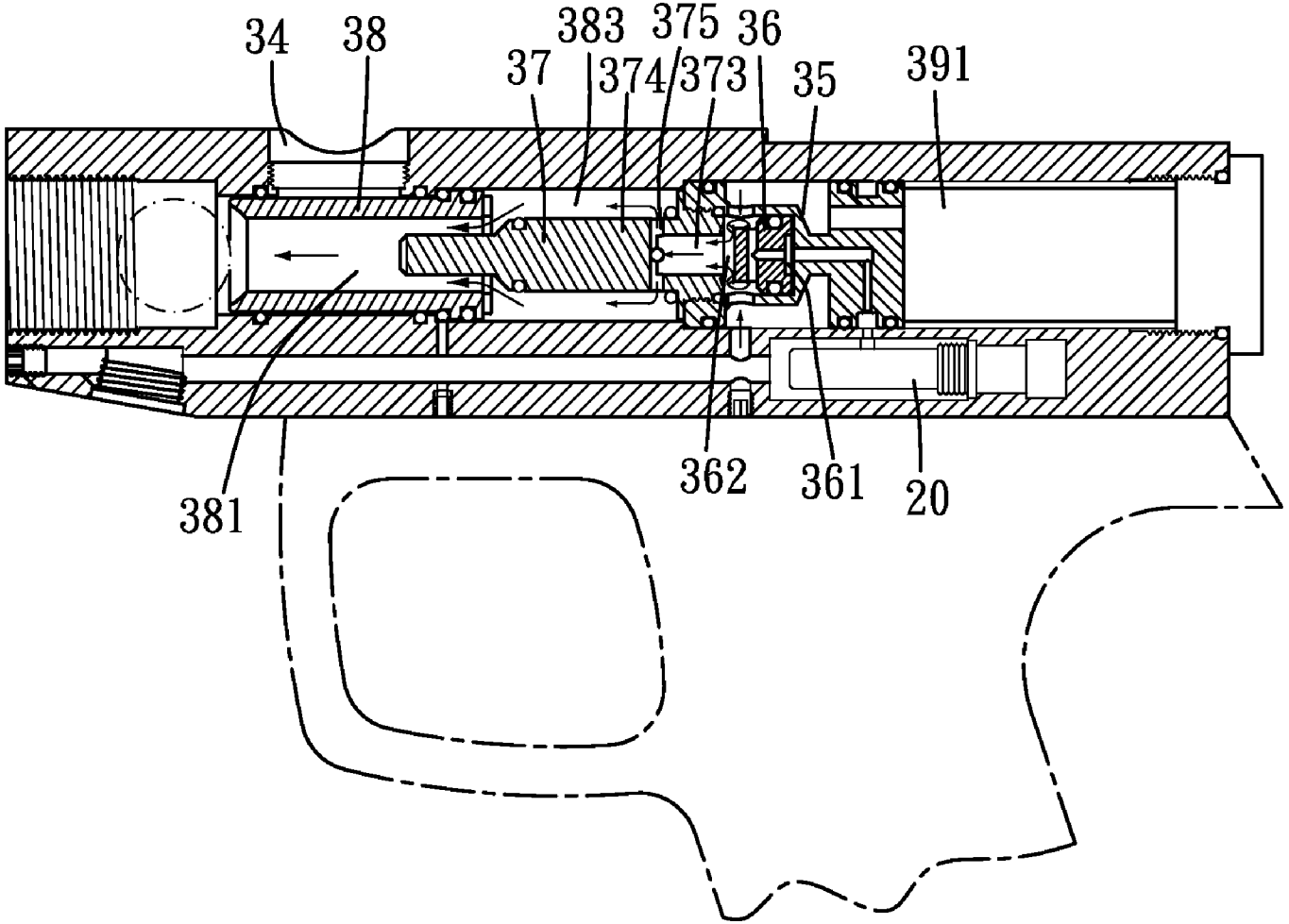
FIG. 5 is a profile showing a pneumatic movement (III) of a paintball gun in accordance with a preferred embodiment of the present invention, in which the air valve is open.

Next, please refer to FIG. 4 and FIG. 5. When the air valve 20 is open, the pneumatic air in the second chamber 361 is evacuated therefrom via the air valve 20, such that the air in the third chamber 362 pushes the piston to the second position, opening the air passage 373 of the axle 37. At the same time, the air in the first chamber 354 and the air chamber 391 flows into the fourth chamber 384 via the air passage 373 and the holes 375 to push the third surface, so that the bolt 38 is pushed to the fourth position and shuts the paintball hole 34. Meanwhile, the bolt 38 disengages from the rod 374 to communicate the projection passage 381 with the fourth chamber 383, evacuating the pneumatic air from the projection passage 381 to project the paintball.

In summary, the paintball gun of the present invention has just a few parts which are relatively easy to be installed than the conventional ones. An air chamber is disposed behind the communicator to provide sufficient and steady air source to increase the projection range of the paintball gun. And, the pull of trigger controls the open/closed of the air valve, so as to further control the movement of both the piston and the bolt, which increases the utilization rate of pneumatic air and streamlines the paintball gun. In addition, the air valve does not involve in the communication between the pneumatic air source and the projection passage as convention art does, which reduces the consumption of air and smoothes the flow of pneumatic air to increase the initial projection speed.

What is claimed is:

1. A paintball gun, comprising:

an air valve, one end thereof communicating a surrounding, and the air valve being selectively turned open or closed; and a body portion, comprising a main body having a hollow receiving room and a first air bore, the body portion further comprising:

a paintball hole, disposed at a predetermined position of the main body and communicating with the receiving room;

a communicator, disposed in the receiving room and having a front section, a middle section and a rear section, between the communicator and the main body being defined a first chamber, the first air bore communicating the first chamber with an inlet; the communicator further having a receiving space, the receiving space being disposed axially and rearward from the front section, on one end of the receiving space away from the front section being disposed a second passage, and at a predetermined position of the middle section being disposed a third passage;

a piston, disposed in the receiving space and being movable between a first position and a second position, the piston dividing the receiving space into a second chamber and a third chamber, and a fourth passage being disposed in the piston, wherein the second passage communicates the second chamber with the air valve, the third passage communicates the third chamber with the first chamber, and the fourth passage communicates the second chamber with the third chamber; moreover, a contacting area between the second chamber and the piston being a first surface, and a contacting area between the third chamber and the piston being a second surface, while an area of the first surface being larger than that of the second surface;

an axle, having a first end and a second end, the first end being fastened to the front section of the communicator, and an air passage, which communicates with the third chamber, being disposed in the first end, and the second end being formed with a cylindrical-shaped rod, at a predetermined position of the rod being disposed a plurality of holes; and a bolt, being movable between a third position and a fourth position, the bolt having a projection passage, a bore diameter of the projection passage being not smaller than an outer diameter of the rod, and at a predetermined position of an outer periphery of the bolt being formed with an annular flange with an outer diameter larger than that of the rod, between the axle, the annular flange and the main body being defined a fourth chamber, a contacting area between the fourth chamber and the annular flange being a third surface, wherein the holes of the rod communicates the fourth chamber with the air passage of the axle;

wherein when the air valve is closed, air in the inlet flows into the first chamber via the first air bore, and then the air flows into the third chamber via the third passage and flows into the second chamber via the fourth passage, the piston is then pushed to the first position and shuts the air passage of the axle because the area of the first surface is larger than that of the second surface, meanwhile, the bolt is at the third position and tightly sleeves the rod of the axle, opening the paintball hole for a paintball to drop into the receiving room;

wherein when the air valve is open, the air in the second chamber is evacuated from the air valve, such that the air in the third chamber pushes the piston to the second position, opening the air passage of the axle, at the same time, the air in the first chamber flows into the fourth chamber via the air passage and the holes to push the third surface, so that the bolt is also pushed to the fourth position and shuts the paintball hole, meanwhile, the bolt disengages from the rod to communicate the projection passage with the fourth chamber, evacuating the air from the projection passage to project the paintball.

2. The paintball gun of claim 1, wherein an outer diameter of the middle section is smaller than those of the front section and the rear section.

3. The paintball gun of claim 1, wherein the main body further has a second air bore, between the bolt, the annular flange and the main body is defined a fifth chamber, and the second air bore communicates the fifth chamber with the inlet, a contacting area between the fifth chamber and the annular flange is a fourth surface, and an area of the third surface is larger than that of the fourth surface;

wherein when the air valve is closed, the air in the inlet also flows into the fifth chamber via the second air bore and pushes the bolt rearward to the third position.

4. The paintball gun of claim 1, wherein the main body further has an air storage, the air storage abuts the rear section of the communicator, an air chamber is defined within the air storage, and between the air chamber and the first chamber is disposed a first passage which communicates the air chamber and the first chamber;

wherein when the air valve is closed, the air in the first chamber also flows into the air chamber via the first passage;

wherein when the air valve is open, the air in the air chamber also flows into the fourth chamber via the air passage and the holes to push the third surface.

* * * * *